US011898264B2

(12) United States Patent
Pesavento et al.

(10) Patent No.: US 11,898,264 B2
(45) Date of Patent: Feb. 13, 2024

(54) TREATMENT METHODS AND SOLUTIONS FOR IMPROVING ADHESION OF GOLD ELECTROPLATING ON METAL SURFACES

(71) Applicant: Hutchinson Technology Incorporated, Hutchinson, MN (US)

(72) Inventors: Paul V. Pesavento, Hutchinson, MN (US); Collin M. Grove, Eau Claire, WI (US); Douglas P. Riemer, Waconia, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 15 days.

(21) Appl. No.: 17/479,569

(22) Filed: Sep. 20, 2021

(65) Prior Publication Data

US 2022/0090284 A1 Mar. 24, 2022

Related U.S. Application Data

(60) Provisional application No. 63/080,936, filed on Sep. 21, 2020.

(51) Int. Cl.

| | |
|---|---|
| ***C25D 5/36*** | (2006.01) |
| ***C23F 17/00*** | (2006.01) |
| ***C23F 1/28*** | (2006.01) |
| ***C25D 3/48*** | (2006.01) |

(52) U.S. Cl.

CPC ..... *C25D 5/36* (2013.01); *C23F 1/28* (2013.01); *C23F 17/00* (2013.01); *C25D 3/48* (2013.01)

(58) Field of Classification Search

CPC ..... C25D 5/36; C23F 1/28; C23F 1/40; C23G 1/088; C23G 1/19

See application file for complete search history.

(56) References Cited

U.S. PATENT DOCUMENTS

| | | | | |
|---|---|---|---|---|
| 3,025,189 | A * | 3/1962 | Arden | C23G 1/19 510/488 |
| 3,677,953 | A * | 7/1972 | Harris | C11D 3/3942 8/111 |
| 4,422,906 | A | 12/1983 | Kobayashi | |
| 2014/0023876 | A1 | 1/2014 | Nagata | |
| 2015/0197870 | A1* | 7/2015 | Farvid | C25D 5/12 205/181 |
| 2016/0208401 | A1* | 7/2016 | Swanson | C25D 3/48 |
| 2020/0181791 | A1 | 6/2020 | Swanson et al. | |

FOREIGN PATENT DOCUMENTS

WO 2014/083318 A1 6/2014

OTHER PUBLICATIONS

Hayashi et al., Machine Translation & Patent, JP S59-185786 A (Year: 1984).*

Huang, Machine Translation and Original, CN 105386066 A (Year: 2016).*

* cited by examiner

*Primary Examiner* — Hosung Chung

(74) *Attorney, Agent, or Firm* — DLA Piper LLP (US)

(57) ABSTRACT

Treatment solutions and methods for improving adhesion of gold electroplating onto metal surfaces are provided herein. More specifically, the disclosure relates to micro-etching stainless steel surfaces using to remove any organic contamination and chromium oxide formed on the surface, neutralize and strip the surface of any iron content, and repassivate the surface with a thin chromium oxide layer, prior to gold electroplating of the stainless steel surfaces.

12 Claims, 7 Drawing Sheets

1000

1100

1000

1100

1200

TREATMENT METHODS AND SOLUTIONS FOR IMPROVING ADHESION OF GOLD ELECTROPLATING ON METAL SURFACES

CROSS-REFERENCE TO RELATED APPLICATIONS

This application claims the benefit of, and priority to, U.S. Provisional Application No. 63/080,936 filed on Sep. 21, 2020, which is hereby incorporated by reference in its entirety.

TECHNICAL FIELD

The present disclosure relates to treatment methods and solutions for improving adhesion of gold electroplating onto metal surfaces.

BACKGROUND

Gold plating of metal surfaces used in electronic and other devices is often essential for providing reliable, low resistance electrical contact with the metal surfaces. This is particularly true of metal surfaces made of materials that naturally form an oxide passivation layer. Such materials include, for example, stainless steels.

Stainless steel is "stainless" because it forms a generally stable chromium oxide which is impervious to most chemicals. This resistance to chemical attack also makes stainless steel a challenging surface for electroplating gold and achieving good adhesion of the plated gold to the stainless steel surface.

Typically, electroplating of gold to stainless steel uses an acid/chloride solution to plate a relatively thin nickel "strike" layer onto the stainless steel. Gold is then electroplated over the nickel layer, which may also be known as a "tie" layer. This works well, so long as the nickel is completely encapsulated by the gold. However, should any nickel be exposed, for example at an edge of a photoresist defined gold/nickel pattern, then a galvanic reaction will occur when the metals come into contact with conductive solutions in subsequent processing steps, such as commonly used metal cleaning processes. The galvanic reaction corrodes the nickel layer and undercuts the gold layer. Undercutting the gold layer destroys the integrity of the patterned gold/nickel structure.

Thus, for applications requiring a patterned gold structure, it is desirable to plate the gold directly onto the stainless steel surface. Various prior art methods have been tried as pretreatments of stainless steel surfaces prior to direct gold plating onto the stainless steel surface, such as wet chemical treatment using caustic/alkaline degreasers for removing organics, using acidic cleans for pitting, electrochemical or plasma etching treatments.

Additionally, stainless steel is sometimes treated with pickling baths. Standard pickling baths are usually very strong acids which will attack circuit metal layers on the stainless steel, and thus these prior art baths can severely roughen, pit or etch the metal layers making them unsuitable for stainless steel substrates with circuits formed thereon.

Each of the aforementioned methods have limitations and defects, which result in poor adhesion of electroplated gold onto the metal layer and exhibit significant failure rates when subjected to standard adhesion tests, such as the industry standard tape tests. Accordingly, new developments are needed to address these problems and limitations.

SUMMARY

Examples of the present disclosure broadly disclose treatment solutions and methods for improving adhesion of gold electroplating onto metal surfaces.

The treatment solutions and methods disclosed herein performs two primary functions: to remove organic contamination from the surface of the stainless steel, and depassivate the stainless steel surface.

In some embodiments, chemical solutions are used to treat the stainless steel surface to remove chromium oxides formed on the surface followed by depassivation of the stainless steel. In some embodiments, the stainless steel surfaces are treated by etching at least a portion of the surfaces with an etchant solution made up of potassium permanganate ($KMnO_4$) and sodium hydroxide (NaOH). The surfaces are subsequently neutralized with a neutralizer solution comprised of ascorbic acid and citric acid.

In one example, the etchant is comprised of potassium permanganate ($KMnO_4$) and sodium hydroxide (NaOH); and the neutralizer is comprised of ascorbic acid and citric acid (ACE).

The treatment method is performed prior to direct gold electroplating of the stainless steel surface (and is sometimes referred to as "pretreatment" with respect to the gold electroplating process). The treatment method results in improved adhesion of the gold to the stainless steel surface, as described in the detailed description below.

Following treatment, any suitable gold electroplating process may be carried out on the stainless steel surface or substrate, such as for example, using the gold electroplating solution and method described in U.S. application Ser. No. 16/794,060, filed on Feb. 18, 2020, entitled "Gold Electroplating Solution and Method," the contents of which are fully incorporated herein by reference in its entirety as though set forth in full.

In additional embodiments, a method of electroplating gold onto a stainless steel surface is provided comprising: treating at least a portion of one or more stainless steel surfaces by exposing the stainless steel surface to a solution comprising potassium permanganate ($KMnO_4$) and sodium hydroxide (NaOH); subsequently neutralizing the at least a portion of one or more stainless steel surfaces by exposing the stainless steel surface to a solution comprised of ascorbic acid and citric acid. The portion of the stainless steel may be exposed to a brief oxygen plasma cleaning process, such as an atmospheric plasma clean or a corona clean.

In some examples, an optional wet cleaning process may follow the plasma cleaning process. In the wet cleaning process, the stainless-steel surface may be immersed in a wet cleaning solution prior to immersion in the gold electroplating solution. The wet cleaning solution may include one or more non-oxidizing mineral or organic acids. In some examples, the wet cleaning solution may include oxalic acid.

The stainless steel may be immersed in a gold electroplating solution; and applying a voltage between an anode within the gold electroplating solution and the stainless steel surface to generate a current from the anode to the stainless steel surface to electroplate gold from the gold electroplating solution onto the stainless steel surface.

While multiple embodiments are disclosed, still other embodiments of the present invention will become apparent to those skilled in the art from the following detailed description, which describes illustrative embodiments of the invention. Accordingly, the detailed description is to be regarded as illustrative in nature and not restrictive.

BRIEF DESCRIPTION OF THE DRAWINGS

The accompanying drawings, which are incorporated in and constitute a part of this specification, exemplify the examples of the present disclosure and, together with the description, serve to explain and illustrate principles of the disclosure. The drawings are intended to illustrate major features of the exemplary embodiments in a diagrammatic manner. The drawings are not intended to depict every feature of actual embodiments nor relative dimensions of the depicted elements, and are not drawn to scale.

Figure 1:
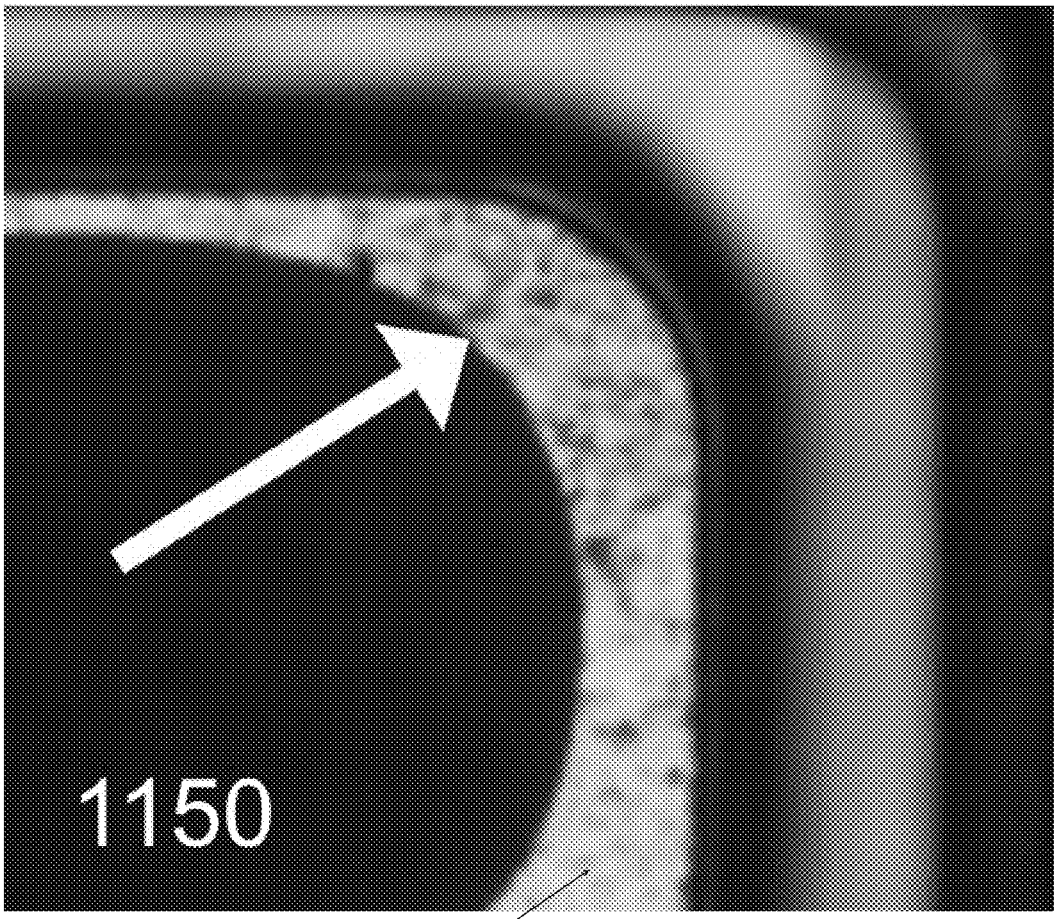
FIGS. 1-2 are photographs of a layered structure including a layer of gold adhered to a stainless steel layer, illustrating poor adhesion achieved with prior art techniques.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments and examples described below disclose treatment methods and solutions for improving adhesion of gold electroplating onto metal surfaces and enable electroplating a layer of gold directly onto a stainless-steel surface. Following treatment, any suitable gold electroplating process may be carried out on the stainless steel surface or substrate, such as for example, using the gold electroplating solution and method described in U.S. application Ser. No. 16/794,060, filed on Feb. 18, 2020, entitled "Gold Electroplating Solution and Method," the contents of which are fully incorporated herein by reference in its entirety as though set forth in full. The resulting electroplated gold layer has good adhesion to the stainless steel surface without need for subsequent heat treatment, cladding pressure or other post treatment to gain needed adhesion.

The treatment solution and method performs the following functions micro-etching the stainless steel surface, neutralizing and stripping the surface, and repassivating the surface. According to embodiments of the present disclosure, these functions are achieved by pretreating one or more surfaces of stainless steel with an etchant (e.g., or pickling solution) that removes any organic contamination on the stainless steel surface, which typically prevents sufficient plasma or chemical treatment of the surface metal oxides to attain superior gold plating adhesion. The etchant is also able to convert/strip the chromium (Cr) oxide and chromium metal content from the stainless steel surface.

According to some examples of the disclosure, micro etching removes the chromium oxides on the surface of the stainless steel but does not materially etch or remove metal from the stainless steel surface. In some examples, the etching process serves as a "pickling" bath which removes/converts the chromium oxide and chromium metal from the stainless steel surface. The etchant solution does not perform any "bulk" etching of the stainless steel metal.

The stainless steel surface is treated a neutralizer to strip iron (Fe) metal content from the surface, thereby enhancing the chromium content and preparing the surface for subsequent repassivation. The stainless steel surface is repassivated with a thin chromium oxide layer that is removable using plating surface treatment operations in a traditional gold plating process. In some examples of the disclosure, the neutralizer refers to a chemical bath that specifically removes excess iron and iron oxide (i.e., derouging, descaling or rust removal) rather than chromium and chromium oxide.

The etchant removes blocking organics and aggressively depassivate the stainless steel surface so the neutralizer passivates the surface to a lesser degree than the original condition of the stainless-steel, such that a gold plating process can depassivate the stainless steel surface for superior adhesion. The etchant and neutralizer process disclosed herein provides a predetermined passivation level to improve the efficiency of gold plating solutions to achieve superior adhesion.

The treatment solution is broadly comprised of an etchant and a neutralizer. In some embodiments, the etchant or pickling solution is comprised of potassium permanganate and sodium hydroxide ($KMnO_4$+NaOH) and the neutralizer is comprised of ascorbic acid and citric acid (ACE).

The inventors have discovered that under basic conditions, the permanganate oxidizes organics on the surfaces of stainless steel, thereby cleaning the surface of baked on organic layers much more effectively than the prior art caustic/acid cleanline processes which only removes light machine oils well. It is believed that the ACE solution acts as a neutralizer for the permanganate. Moreover, the ACE solution improves adhesion by removing excess iron and iron oxide from the stainless steel surface after microetching such that the surface achieves a predetermined level of passivation.

The permanganate also enables the removal of chromium (Cr) oxides on the surfaces of the stainless-steel by converting insoluble $Cr^{+3}$ oxides to $Cr^{+6}$ allowing them to be dissolved more readily in downstream processing steps. This results in thinner oxides layers on the surfaces of the stainless steel when gold electroplating steps are performed, which can be more effectively treated and removed by a pretreatment process.

It is important to note that standard, industrial pickling processes and baths are usually very strong acids which will erode the circuit's metal layers, and thus the prior art pickling baths can severely roughen, pit, and/or etch the metal layers. In contrast, the present invention utilizes potassium permanganate and sodium hydroxide and achieves the goal of removing excess iron and iron oxide from the stainless-steel surface after microetching such that the surface achieves a predetermined level of passivation. The predetermined level of passivation of the stainless steel surface enables superior direct gold on stainless steel adhesion while simultaneously prevents degradation of the attached metal circuitry layers. This is a significant improvement over the prior art.

The etching step dissolves chromium metal and converts chromium oxide, present on the stainless steel surface, to a soluble form. Following removal of organic contamination and highly passive chromium oxide and chromium metal content from the stainless steel surface, the stainless steel is depassivated with a neutralizer. In some examples, the neutralizer is comprised of ascorbic acid and citric acid (ACE). Alternatively, other neutralizers may be used, such as without limitation nitric acid, oxalic acid, EDTA, and the like. The neutralizer neutralizes the etchant and removes the iron metal content from the surface of the stainless steel, thereby enhancing the chromium content and enabling the surface for subsequent repassivation. The stainless steel surface is exposed to air, or alternatively allowed to rest for a predetermined amount of time to repassivate the surface and restores a thin chromium oxide layer on the surface.

In some embodiments, the concentration of potassium permanganate in the etchant solution is between about 0.1 molarity (M) and 0.4 M, and the sodium hydroxide is added until the etchant solution has a pH greater than 12.5. The stainless steel surface may be exposed to the etchant solution for a period of time between 1 and 300 seconds at a temperature between 5.0 and 85 degrees Celsius.

In other embodiments, the concentration of potassium permanganate in the etchant solution is between about 0.15 M and 0.3 M, and the sodium hydroxide is added until the etchant solution has a pH greater than 13. The stainless steel surface may be exposed to the etchant solution for a period of time between 5 and 60 seconds at a temperature between 15 and 50 degrees Celsius.

In other examples, the concentration of potassium permanganate in the etchant solution is between about 0.2 M and 0.25 M, and the sodium hydroxide is added until the etchant solution has a pH greater than 14. The stainless steel surface may be exposed to the etchant solution for a period of time between 20 and 40 seconds at a temperature between 20 and 30 degrees Celsius.

In some embodiments, the concentration of ascorbic acid in the neutralizer solution is between about 75 g/L and 250 g/L, and the concentration of citric acid is between about 50 g/L and 200 g/L. The sodium hydroxide is added until the neutralizer solution has a pH between 1.4 and 2.4. The stainless-steel surface may be exposed to the neutralizer solution for a period of time between 1 and 300 seconds at a temperature between 25 and 85 degrees Celsius.

In other embodiments, the concentration of ascorbic acid in the neutralizer solution is between about 110 g/L and 200 g/L, and the concentration of citric acid is between about 75 g/L and 150 g/L. The sodium hydroxide is added until the neutralizer solution has a pH between 1.6 and 2.3. In some embodiments, the stainless steel surface is exposed to the neutralizer solution for a period of time between 10 and 60 seconds at a temperature between 35 and 65 degrees Celsius.

In other examples, the concentration of ascorbic acid in the neutralizer solution is between about 130 g/L and 170 g/L, and the concentration of citric acid is between about 100 g/L and 130 g/L. The sodium hydroxide is added until the neutralizer solution has a pH between 1.8 and 2.2. In some examples, the stainless steel surface is exposed to the neutralizer solution for a period of time between 20 and 40 seconds at a temperature between 45 and 55 degrees Celsius.

Figure 2:
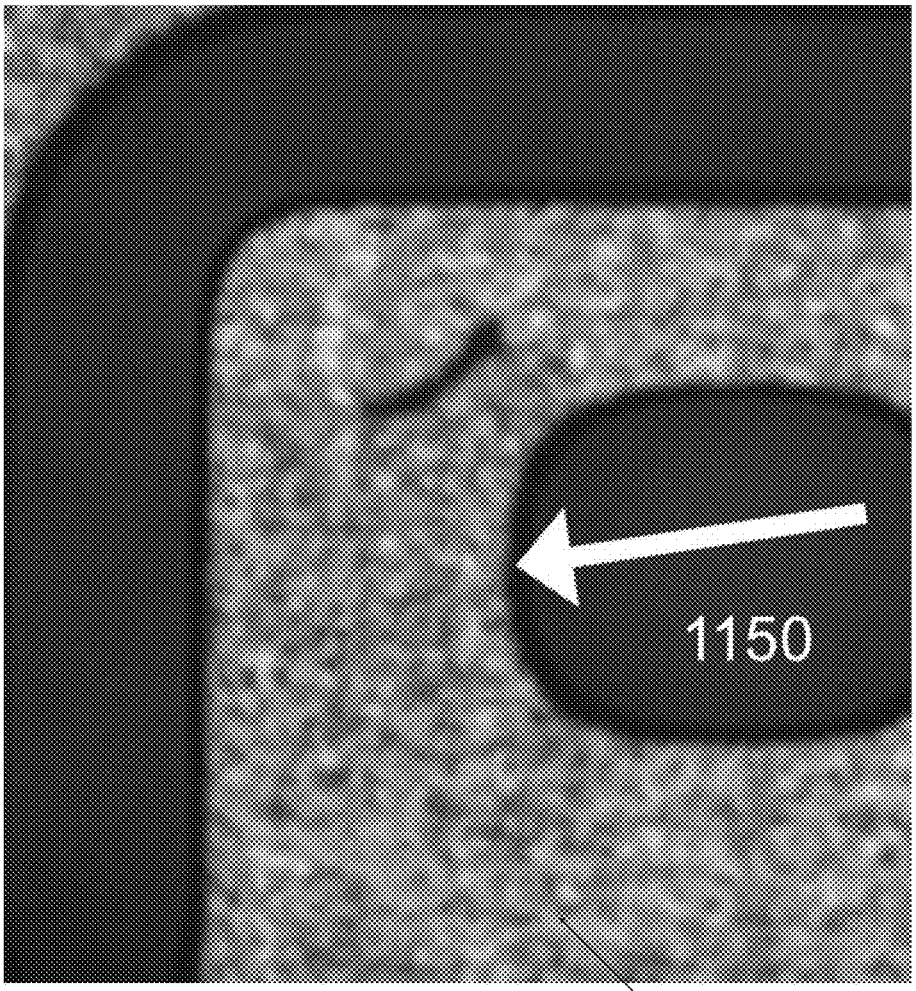

As discussed above in the Background, typical prior art pretreatment cleaning processes result in poor adhesion of gold onto the stainless steel. For example, FIGS. 1 and 2 illustrate poor adhesion of gold where an oxygen plasma cleaning process was used to pretreat the stainless steel prior to gold electroplating. More specifically, FIGS. 1 and 2 show photographs of two different layered structures 1000 including a layer of gold 1100 adhered to a stainless steel (SST) layer 1150. As shown in both structures, adhesion of gold is poor with significant portions lacking the gold plating layer 1100.

As described herein, the disclosed pretreatment embodiments provide improved adhesion of gold electroplated on stainless steel, by microetching the stainless steel surface, neutralizing the etchant solution, and repassivating the stainless steel after micro-etching. The disclosed process of micro-etching removes an organic contamination and chromium oxide from the stainless steel surface while the neutralizer removes the iron metal content of the surface thereby enhancing the chromium content. Specifically, the etchant solution removes the oxide layer and dissolves this chromium-depleted layer beneath the oxide layer. Alternatively, the etchant solution dissolves the chromium oxide on the stainless-steel surface leaving iron oxides, which is removed using the neutralizer. The stainless-steel is subsequently exposed to atmospheric conditions for a predetermined time period to repassivate the surface with a predetermined (e.g., thin) chromium oxide layer.

In some examples, the neutralizer may include ascorbic acid or citric acid. Moreover, other compounds may be used such as nitric acid, oxalic acid, or ethylenediaminetetraacetic acid (EDTA) in combination with other compounds, which restores a thin chromium-oxide surface. The etchant solution ensures uniformity for the stainless-steel surface to include a thin chromium-oxide, in comparison to a standard pickling baths that typically erodes the circuit's metal layers.

In contrast to the standard industrial pickling baths, the neutralizer removes iron metal content and subsequently modifies the stainless-steel surface for improved direct gold (Au) on stainless-steel adhesion, while simultaneously preventing degradation of the attached metal circuitry layers.

Following treatment of the stainless steel as described above, gold is electroplated on the surface of the treated stainless steel. Any suitable gold electroplating process may be used. In one embodiment, the gold electroplating solution and method described in U.S. application Ser. No. 16/794,060, filed on Feb. 18, 2020, entitled "Gold Electroplating Solution and Method," the contents of which are fully incorporated herein by reference in its entirety as though set forth in full may be used. As described therein, the gold electroplating solution includes a gold (III) cyanide compound, a chloride compound, and hydrochloric acid. The gold (III) cyanide compound is at least one of potassium gold (III) cyanide, ammonium gold (III) cyanide, and sodium gold (III) cyanide. The chloride compound is at least one of potassium chloride, ammonium chloride, and sodium chloride. If the gold (III) cyanide compound is potassium gold (III) cyanide, then the chloride compound is potassium chloride; if the gold (III) cyanide compound is ammonium gold (III) cyanide, then the chloride compound is ammonium chloride, and if the gold (III) cyanide compound is sodium gold (III) cyanide, then the chloride compound is sodium chloride. In some methods the gold (III) cyanide compound is potassium gold (III) cyanide and the chloride compound is potassium chloride.

In some situations, sufficient hydrochloric acid is added to the gold electroplating solution such that the gold electroplating solution has a pH between about 0 and about 1, or such that the gold electroplating solution has a pH between about 0.7 and about 0.9. Such methods can also include maintaining a concentration of potassium gold (III) cyanide in the gold electroplating solution between about 1.0 grams of gold per liter of solution and 3.0 grams of gold per liter of solution and maintaining a concentration of chloride anions in the gold electroplating solution between about 0.30 moles per liter of solution and 0.60 moles per liter of solution. Such methods can further include maintaining a concentration of potassium gold (III) cyanide in the gold electroplating solution between about 1.8 grams of gold per liter of solution and 2.2 grams of gold per liter of solution and maintaining a concentration of chloride anions in the gold electroplating solution between about 0.45 moles per liter of solution and 0.55 moles per liter of solution.

In one example, during electroplating the voltage generates a continuous direct current, in which the continuous direct current produces a current density at the stainless steel surface of between 1 ampere per square decimeter and 40 amperes per square decimeter. In such methods, the voltage generates a pulsed direct current, and the pulsed direct current may produce a time averaged current density at the stainless steel surface of between 1 ampere per square decimeter and 40 amperes per square decimeter.

The methods described herein for producing an electrodeposited gold pattern directly onto a stainless steel surface may be employed for depositing gold on a stainless steel surface of a disk drive head suspension, an optical image stabilization suspension, or a medical device.

EXAMPLES

The present invention is more particularly described in the following examples that are intended as illustration only, since numerous modifications and variations within the scope of the present invention will be apparent to those skilled in the art. Tape tests were conducted on gold electroplated stainless steel test samples prepared according to examples of the present disclosure.

The stainless steel test sample was treated using an etchant solution to convert/strip the highly passive chromium oxide/chromium metal content from the surface of the stainless steel. The etchant solution includes a concentration of potassium permanganate in the solution of 0.23 M. The sodium hydroxide is added until the etchant solution has a pH greater than 14. The stainless steel surface is exposed to the etchant solution for a period of 30 seconds at a temperature of 25-degrees Celsius.

The stainless steel test sample was treated using a neutralizer solution to neutralize the etchant solution and strip the iron metal content from the stainless steel surface, thereby enhancing the chromium content and setting up the surface for subsequent repassivation. The neutralizer concentration of ascorbic acid in the neutralizer solution is 150 g/L, and the concentration of citric acid is 115 g/L. The sodium hydroxide is added until the neutralizer solution has a pH of 2.0. The stainless steel surface is exposed to the neutralizer solution for 30 seconds at a temperature of 50-degrees Celsius. The stainless steel surface is pretreated, and the stainless-steel surface is gold plated.

Adhesion tests were performed on the pretreated stainless steel surfaces according to the embodiments described herein which were then plated with gold. Adhesion may be verified by any suitable method known in the art, such as a tape test, scratch test, bend test, peel test or any other pull or shear test. A more quantifiable scratch test may be conducted by forming lines and spaces by electroplating gold to a thickness of at least 3 microns, and then running a razor blade across a group of 20-micron lines and spaces. Electroplated gold having unsuitable or bad adhesion to the stainless steel surface will peel away from the stainless steel surface. For example, the gold layer will separate from the stainless steel surface, suggesting poor adhesion upon the existence of any voids between the gold and the stainless steel. Further verification of void free plating (i.e, of superior or suitable adhesion) may be provided by observation of the interface between gold and stainless steel by focused ion beam.

Tape tests were conducted on gold electroplated stainless steel test samples prepared according to embodiments of the present disclosure. Results are shown in Table 1 below:

TABLE 1

| | Tape Test Fails (300 max) |
|---|---|
| Prior art process | 144 |
| Treatment process of the present disclosure | 0 |

As indicated in Table 1, the disclosed pretreatment process resulted in zero failures.

Example Structures

The treatment of stainless steel using the new solution and process described herein followed by direct electroplating of a gold layer directly onto a stainless steel layer with improved adhesion facilitates the development of advantageous gold patterns that may be used in hard disk drive suspensions, among other devices. Those having skill in the art and the benefit of this disclosure will recognize that the methods and solutions described herein may be used to improve adhesion of gold electroplated onto stainless steel surfaces and substrates in a variety of other suitable applications as well, for example without limitation, optical image stabilization suspension devices (such as, e.g., those of the type disclosed in PCT International Publication No. WO 2014/083318) and insertable or implantable medical devices (such as, e.g., catheters, pacemakers, defibrillators, leads and electrodes), among other devices.

Figure 3A:
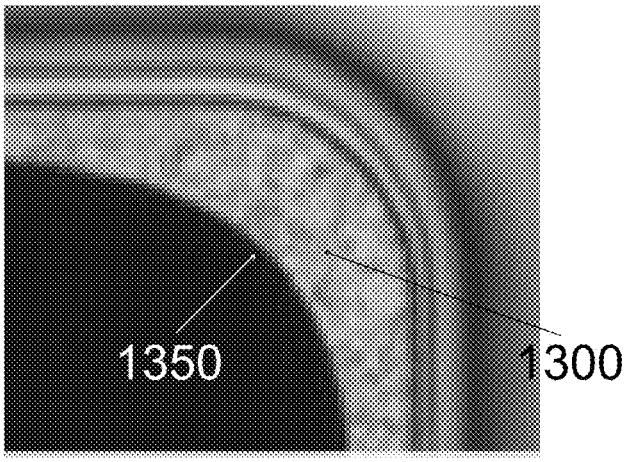
FIGS. 3A-3C are photographs of a layered structure including a layer of gold adhered to a stainless steel layer, illustrating improved adhesion achieved according to some embodiments of the present invention.
Figure 3B:
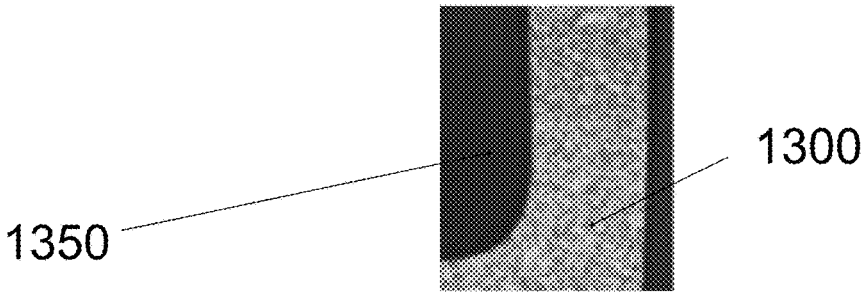
Figure 3C:
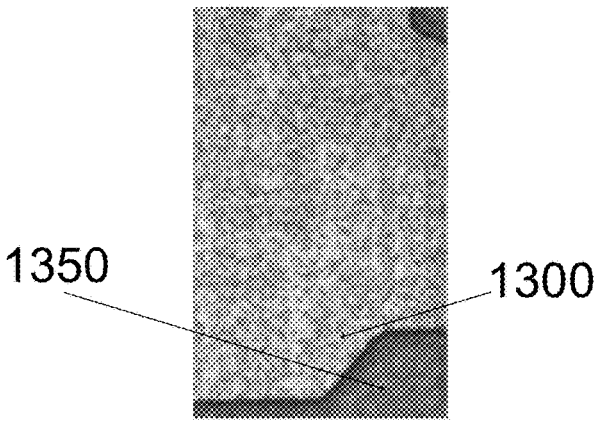

FIGS. 3A-3C are photographs of a layered structure 1200 including a layer of gold 1300 adhered to a stainless-steel layer 1350, illustrating improved adhesion achieved according to some example of the present disclosure.

Figure 4:
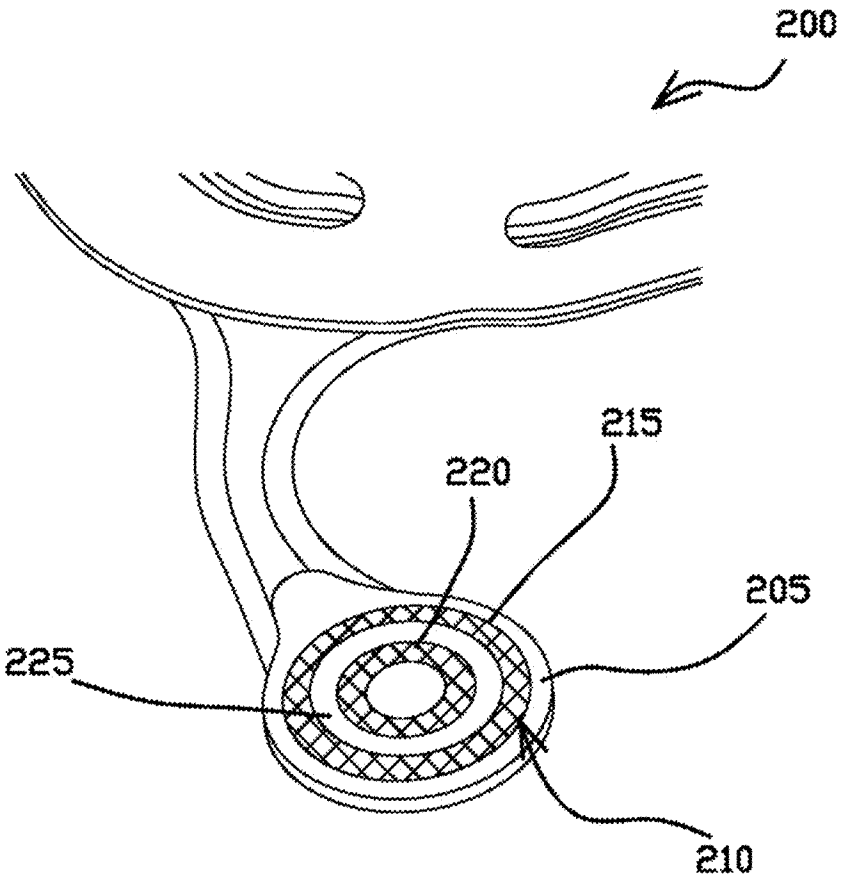
FIG. 4 is a perspective view of a portion of a hard disk drive suspension component having a gold pattern, according to some embodiments.

FIG. 4 is a perspective view of a portion of a hard disk drive suspension component 200 having a gold pattern 210, according to some embodiments. The component 200 includes a stainless steel pad 205 and a gold pattern 210 electrodeposited directly onto the stainless steel pad 205. A gold electrodeposition process with a photoresist is capable of producing a gold pattern 210 on the SST pad 205 that is discontinuous. In other words, the gold pattern may comprise unconnected, independent shapes. The gold pattern 210 may be wholly separated by spaces or gaps without gold, leaving the SST pad 205 exposed. In the illustrated embodiment, the gold pattern 210 comprises a first concentric ring 215 and a second concentric ring 220 interior to the first concentric ring. The gold pattern 210 further includes a gap 225 separating the concentric rings 215, 220 leaving a portion of the SST pad 205 exposed. As shown, the gap 225 may completely separate the concentric rings 215, 220 when desired. Though the gold pattern 210 contains several edges, the gold pattern is less susceptible to flaking than if a nickel layer were deposited between the gold and the stainless steel.

Figure 5:
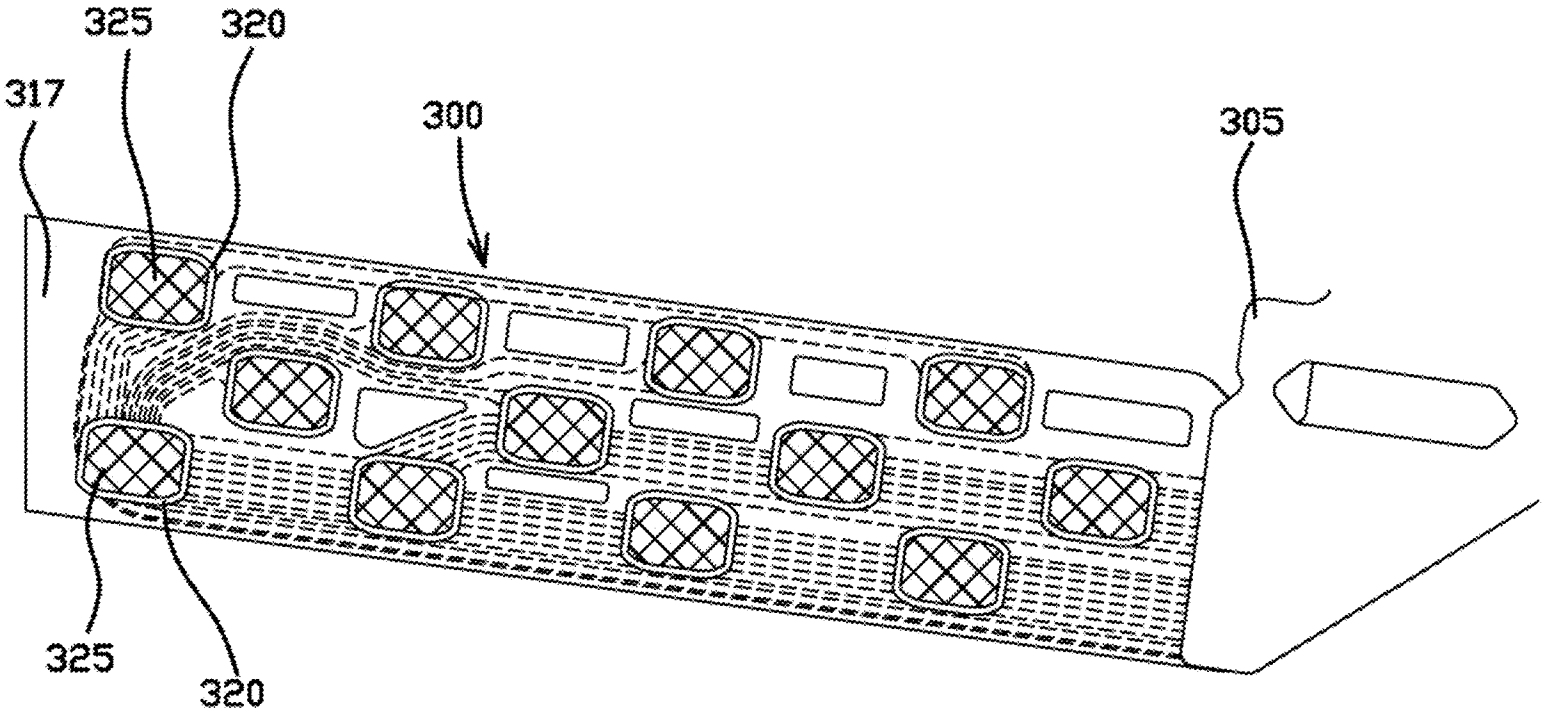
FIGS. 5-6 are top and bottom side views, respectively, of a suspension flexure tail having a stainless steel side with an stainless steel layer and a trace side with a trace layer and a gold pattern electrodeposited on stainless steel, according to some embodiments.
Figure 6:
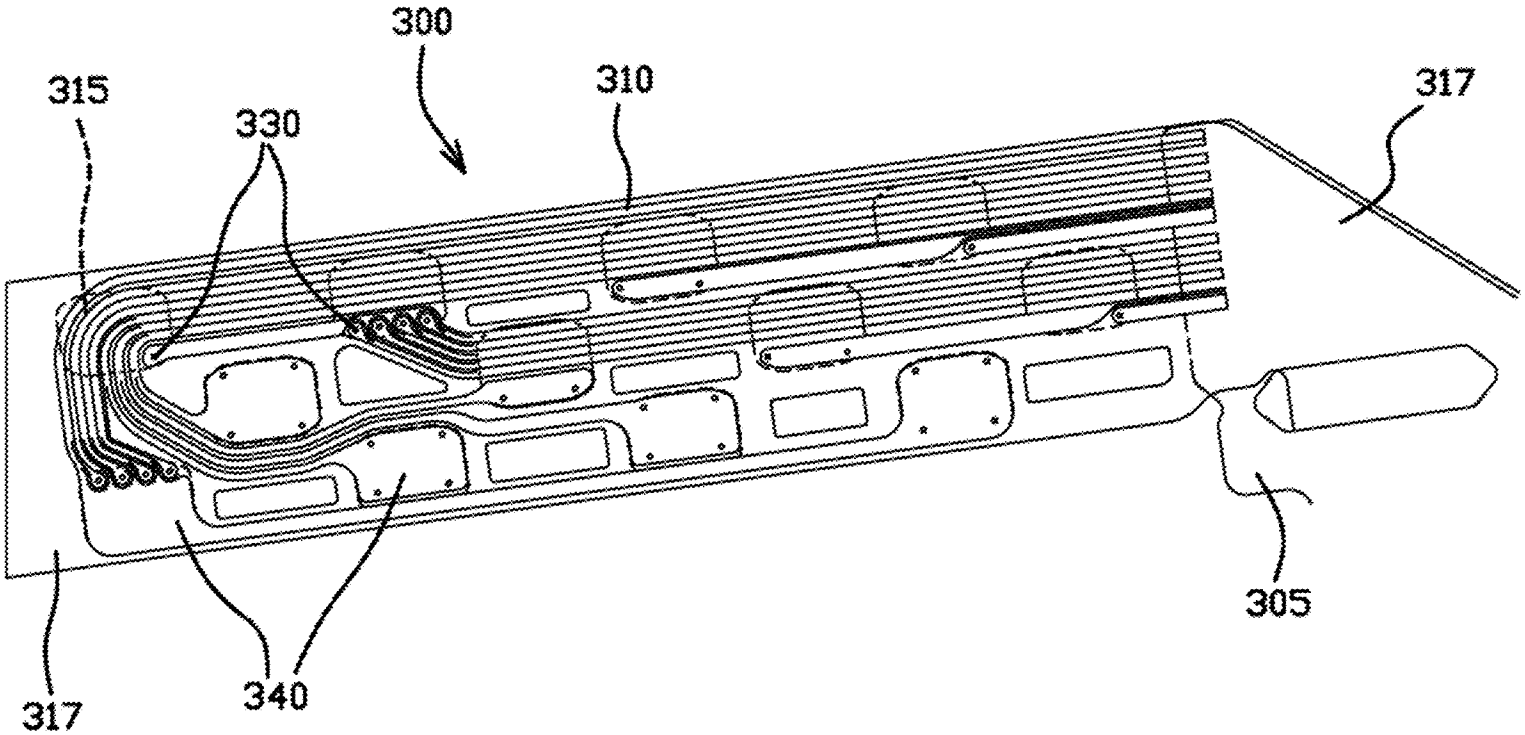

FIGS. 5 and 6 are top and bottom side views, respectively, of a suspension flexure tail 300 having a stainless steel side with a stainless steel layer 305 and a trace side with a trace layer 310 and a gold pattern electrodeposited on stainless steel, according to some embodiments. A dielectric layer 317 typically separates the stainless steel layer 305 and the trace layer 310. The tail 300 may be electrically coupled to another circuit at one or more bonding areas using anisotropic conductive film (ACF) to form one or more connections. This type of bonding typically utilizes a stainless steel pad backing for structural support during bonding to a copper bond pad. The capability to directly electroplate a gold pattern on the stainless steel pad allows the stainless steel pad to be used as an electrically bonded pad in addition to being structural support.

Perhaps as best seen in FIG. 6, the tail 300 includes a stainless steel layer 305 having one or more stainless steel pads 320. In certain embodiments, the stainless steel pads 320 are each electrically isolated from the rest of the stainless steel layer 305 and from other stainless steel pads. One or more of the stainless steel pads 320 has a corresponding gold bond pad 325. In certain embodiments, a gold bond pad 325 is deposited directly onto a stainless steel pad 320 through an electrodeposition process with a photoresist. The gold bond pad 325 provides an enhanced electrical coupling interface relative to the bare stainless steel pad 320. As a result of the improved electrical properties, the gold bond pads 325 on the stainless steel pads 320 can be used as bonding terminals on the tail 300. In some embodiments, all stainless steel pads 320 have a corresponding gold bond pad 325. In other embodiments (not shown), less than all stainless steel pads have a corresponding gold bond pad.

Figure 7:
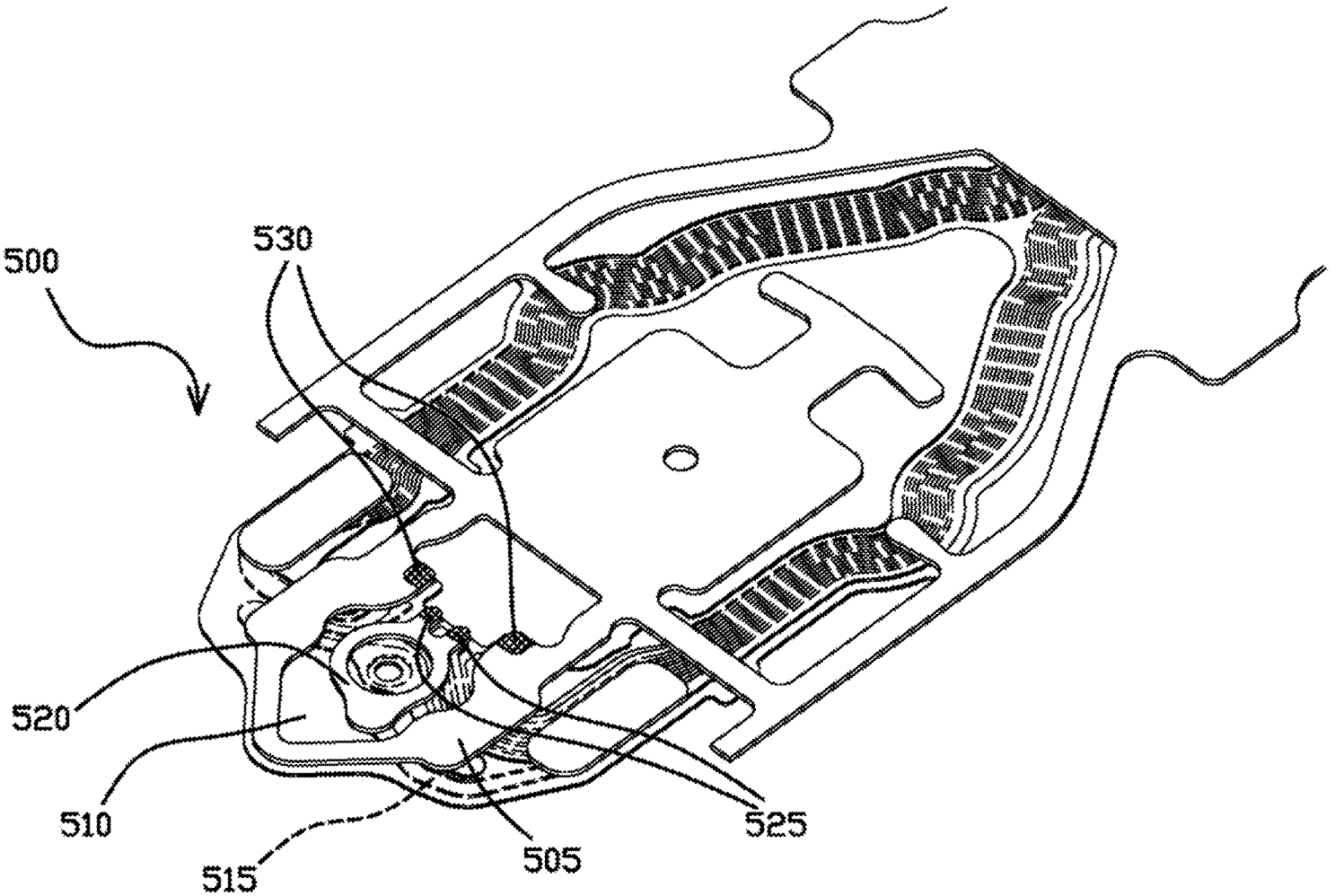
FIG. 7 is a perspective view of a gimbal having a gold pattern electrodeposited on SST, according to some embodiments.

FIG. 7 is a perspective view of a gimbal 500 having a gold pattern electrodeposited on stainless steel, according to some embodiments. As shown, the gimbal 500 is structured to receive a laser diode as part of a heat-assisted magnetic recording (HAMR) gimbal. The illustrated gimbal 500 includes a stainless steel layer 505 disposed on a dielectric layer 510, which is at least partially backed by a trace layer 515. The stainless steel layer 505 includes a stainless steel island 520, which is electrically isolated from other portions of the stainless steel layer 505. A first set of one or more gold bond pads 525 may be directly deposited on the stainless steel island 520. A second set of one or more gold bond pads 530 may be directly disposed on another portion of the stainless steel layer 505. The first and second sets of gold bond pads 525, 530 together provide two electrical terminals for a laser diode. This structure may be manufactured more easily than a structure utilizing copper pads, as discussed herein with respect to other embodiments.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A method of treating one or more stainless steel surfaces, comprising:

etching at least a portion of one or more stainless steel surfaces with an etchant solution comprised of potassium permanganate (KMnO4) and sodium hydroxide (NaOH), the one or more stainless steel surfaces including a metal circuit layer disposed on the one or more stainless steel surfaces, wherein a concentration of the potassium permanganate in the etchant solution is between 0.1 M and 0.4 M, and the sodium hydroxide is added until the etchant solution has a pH greater than 12.5;

exposing at least the portion of the one or more stainless steel surfaces to the etchant solution fora period of time between 1 second and 5 minutes and at a temperature between 5.0 and 85 degrees Celsius;

subsequently neutralizing at least the portion of the one or more stainless steel surfaces with a neutralizer solution comprised of ascorbic acid and citric acid;

repassivating at least the portion of the one or more stainless steel surfaces with a chromium oxide layer; and removing the chromium oxide layer using a plating surface treatment operation.

2. The method of claim 1 wherein a concentration of ascorbic acid in the neutralizer solution is between 75 g/L and 250 g/L, and the concentration of citric acid is between 50 g/L and 200 g/L.

3. The method of claim 1 wherein at least the portion of the one or more stainless steel surfaces is exposed to the neutralizer solution for a period of time between 1 and 300 seconds.

4. The method of claim 1 wherein at least the portion of the one or more stainless steel surfaces is exposed to the neutralizer solution at a temperature between 25 and 85 degrees Celsius.

5. The method of claim 1, wherein the etching step dissolves chromium metal and converts chromium oxide, present on at least the portion of the one or more stainless steel surfaces, to a soluble form.

6. A method of electroplating gold onto one or more stainless steel surfaces, the method comprising:

treating at least a portion of one or more surfaces of stainless steel by exposing each of the one or more surfaces of stainless steel to a solution comprising potassium permanganate (KMnO4) and sodium hydroxide (NaOH), the one or more surfaces of stainless steel including a metal circuit layer disposed on the one or more surfaces of stainless steel, wherein a concentration of the potassium permanganate in the etchant solution is between 0.1 M and 0.4 M, and the sodium hydroxide is added until the etchant solution has a pH greater than 12.5;

exposing at least the portion of the one or more stainless steel surfaces to the etchant solution fora period of time between 1 second and 5 minutes and at a temperature between 5.0 and 85 degrees Celsius;

subsequently neutralizing at least the portion of the one or more surfaces of stainless steel by exposing each of the one or more surfaces of stainless steel to a solution comprised of ascorbic acid and citric acid;

exposing at least the portion of the one or more surfaces of stainless steel to an oxygen plasma cleaning process and a wet cleaning process solution;

repassivating at least the portion of the one or more stainless steel surfaces with a chromium oxide layer;

removing the chromium oxide layer using a plating surface treatment operation;

immersing the one or more surfaces of stainless steel in a gold electroplating solution; and applying a voltage between an anode within the gold electroplating solution and at least the portion of the one or more surfaces of stainless steel to generate a current from the anode to at least the portion of the one or more surfaces of stainless steel to electroplate gold from the gold electroplating solution onto at least the portion of the one or more surfaces of stainless steel.

7. The method of claim 6, wherein the treating step dissolves chromium metal and converts chromium oxide to a soluble form.

8. The method of claim 6, wherein a concentration of ascorbic acid in the neutralizer solution is between 75 g/L and 250 g/L, and the concentration of citric acid is between 50 g/L and 200 g/L.

9. The method of claim 6, wherein at least the portion of the one or more surfaces of stainless steel is exposed to the neutralizer solution for a period of time between 1 and 300 seconds.

10. The method of claim 6, wherein at least the portion of the one or more surfaces of stainless steel is exposed to the neutralizer solution at a temperature between 25 and 85 degrees Celsius.

11. The method of claim 6, wherein the gold electroplating solution includes:

a gold (III) cyanide compound, the gold (III) cyanide compound being one of potassium gold (III) cyanide, ammonium gold (III) cyanide, and sodium gold (III) cyanide;

a chloride compound, the chloride compound being one of potassium chloride, ammonium chloride, and sodium chloride; and hydrochloric acid, wherein if the gold (III) cyanide compound is potassium gold (III) cyanide, then the chloride compound is potassium chloride; if the gold (III) cyanide compound is ammonium gold (III) cyanide, then the chloride compound is ammonium chloride, and if the gold (III) cyanide compound is sodium gold (III) cyanide, then the chloride compound is sodium chloride.

12. The method of claim 6, wherein the method de posits gold on the one or more surfaces of stainless steel that are part of a disk drive head suspension, flexure, an optical image stabilization suspension, or a medical device.

* * * * *